United States Patent [19]

Link et al.

[11] 4,334,790

[45] Jun. 15, 1982

[54] TYPE DISC TYPEWRITER WITH ELECTRONIC POSITIONING CONTROL

[75] Inventors: Manfred Link; Diethelm Puch, both of Nuremberg, Fed. Rep. of Germany; Peter Zahner, Schwab-hausen, Austria; Karel Suc, Furth Kreutles, Fed. Rep. of Germany

[73] Assignee: Triumph Werke Nurnberg A.G., Nuremberg, Fed. Rep. of Germany

[21] Appl. No.: 99,541

[22] Filed: Dec. 3, 1979

[30] Foreign Application Priority Data

Jul. 27, 1978 [DE] Fed. Rep. of Germany ..... 2832954

[51] Int. Cl.[3] ..... B41J 1/30

[52] U.S. Cl. ..... 400/144.2; 101/93.19

[58] Field of Search ..... 400/144.1, 144.2, 155, 400/163.1; 178/28, 34; 101/93.19

[56] References Cited

U.S. PATENT DOCUMENTS 1,467,191 9/1923 Ormsby ..... 400/144.1

2,161,840 6/1939 Adams ..... 400/144.2 X 4,198,169 4/1980 Stuiber et al. ..... 400/144.2

4,203,680 5/1980 Mitrovich ..... 400/144.2 X

FOREIGN PATENT DOCUMENTS 1786605 1/1975 Fed. Rep. of Germany ... 400/141.1

*Primary Examiner*—Paul T, Sewell

[57] ABSTRACT

Keyboard generated signals are digitally encoded and converted to varying voltages for application to a coil for generating magnetic forces. The magnetic forces act on a spring mass system including a type disc to rotate the type disc to a selected angular position. The rest position of the disc at any selected angular position is established when the applied magnetic force and the force of an oppositely acting spring reach equilibrium condition. The spring stores or releases energy according to whether the applied magnetic force is greater or less than the existing spring force. The parameters of the system are so chosen that movement from one angular position of rest to another is smoothly accomplished in a given time.

4 Claims, 9 Drawing Figures

Fig_1
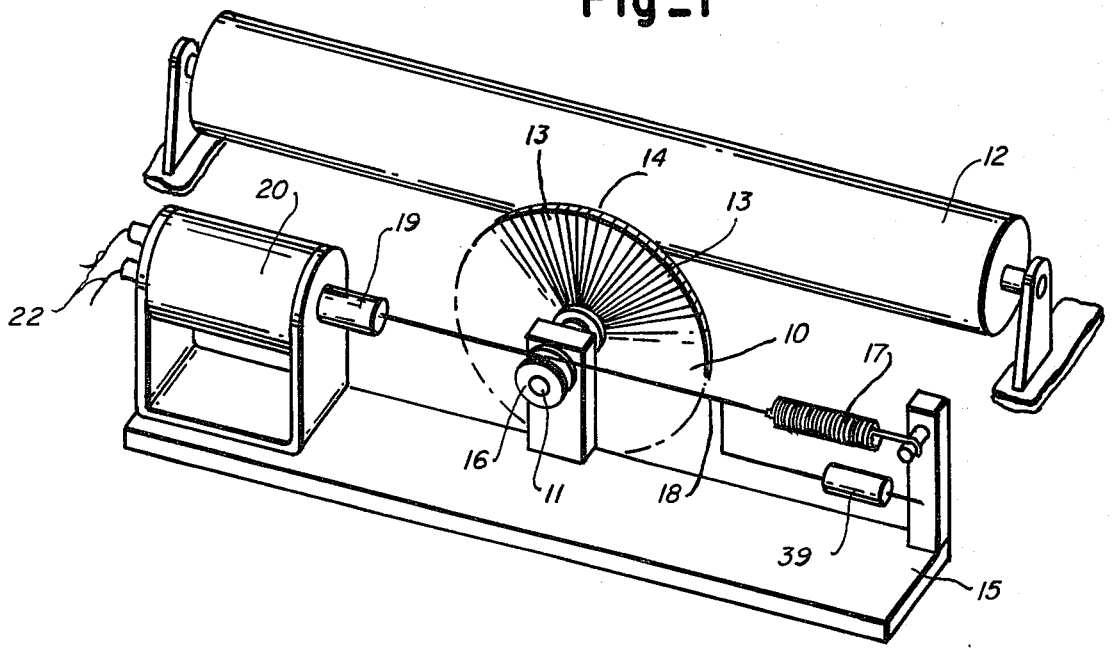
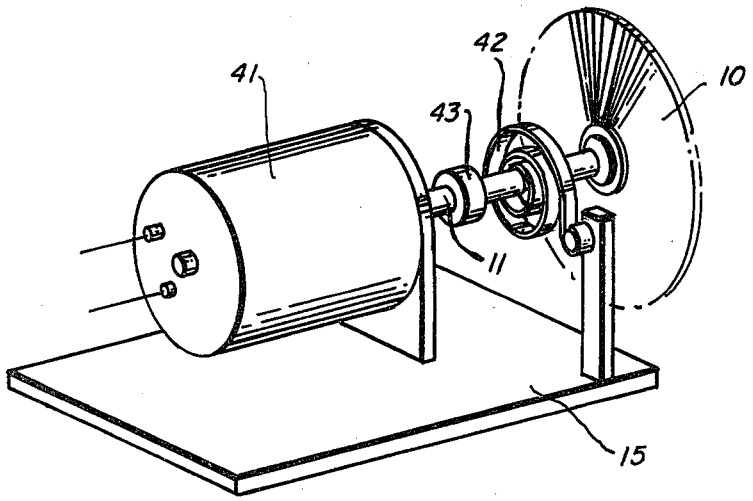
Fig_7

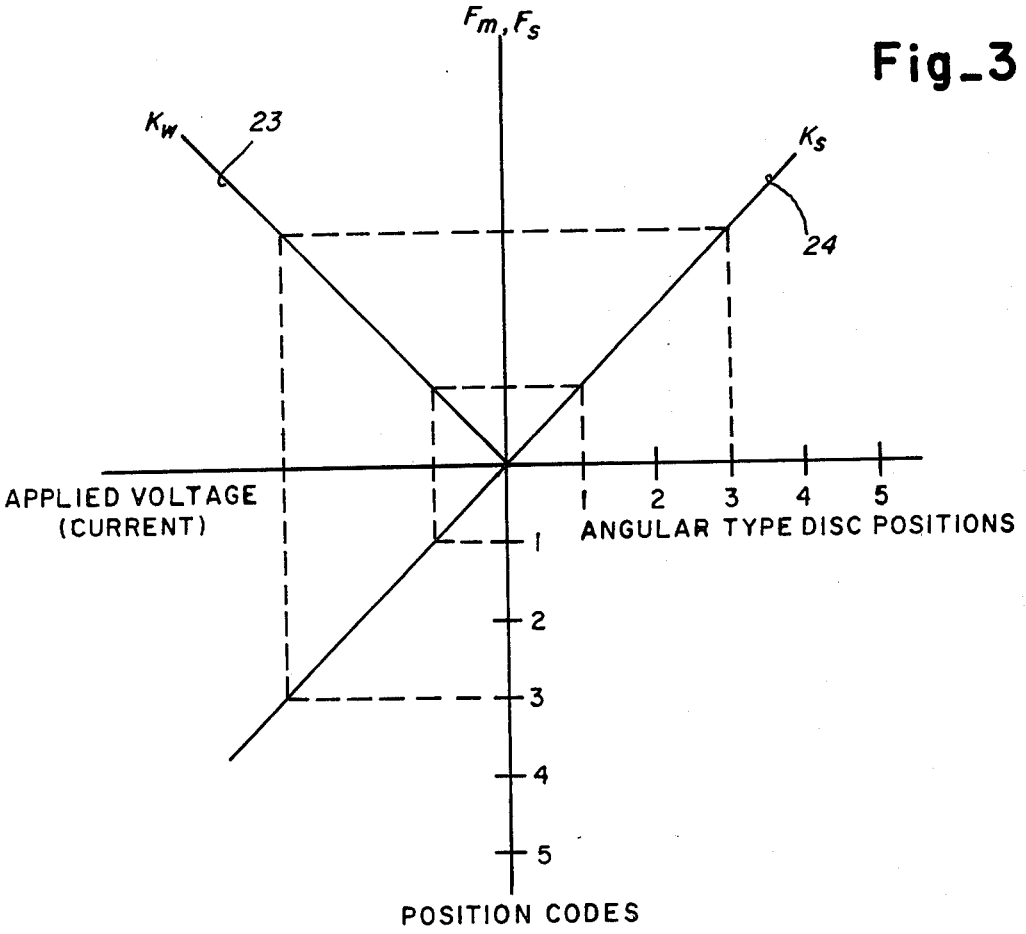
Fig_3
$F_m, F_s$
$K_W$
23
$K_S$
24
APPLIED VOLTAGE
(CURRENT)
1
2
3
4
5
ANGULAR TYPE DISC POSITIONS
1
2
3
4
5
POSITION CODES
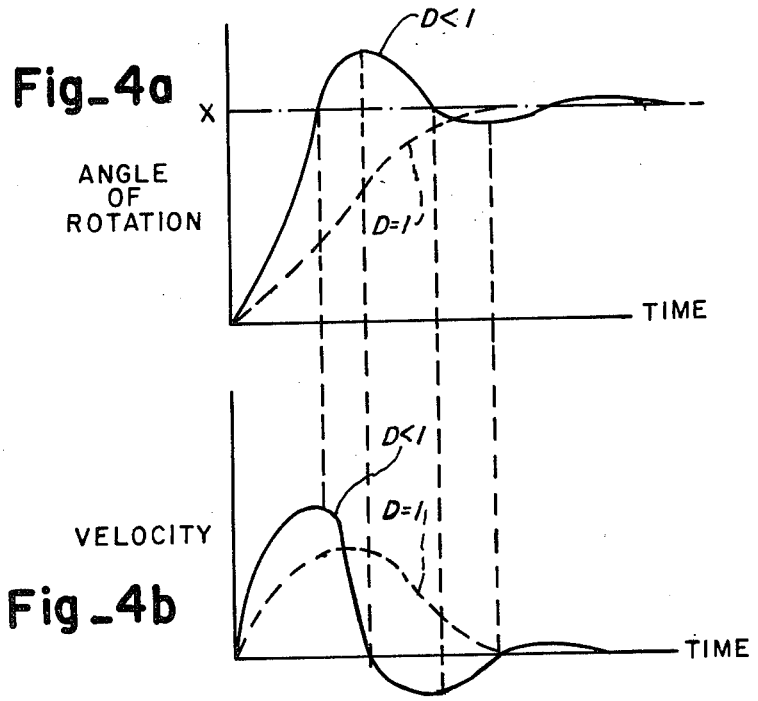
Fig_4a
D<1
X
ANGLE
OF
ROTATION
D=1
TIME
D<1
D=1
VELOCITY
Fig_4b
TIME Fig_5a
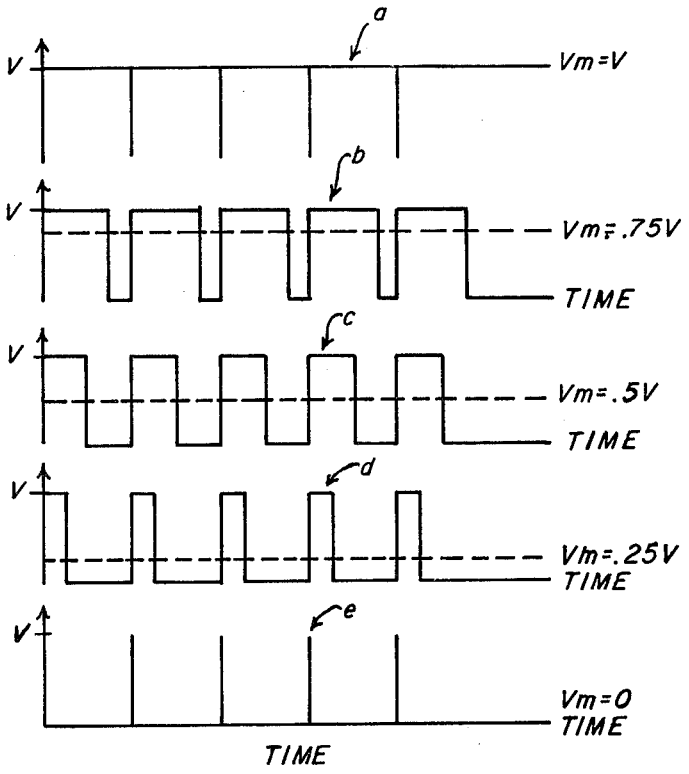
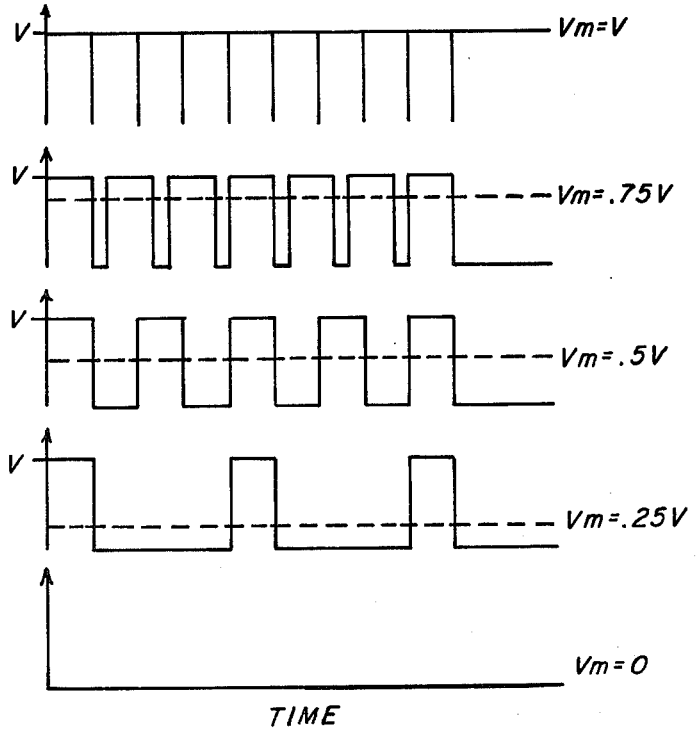
Fig_5b

TYPE DISC TYPEWRITER WITH ELECTRONIC POSITIONING CONTROL

This invention relates to a type disc typewriter; more particularly it relates to a type disc typewriter having a balanced force type disc positioning system wherein at all angular type disc positions an equilibrium exists between applied forces and spring forces; and specifically to a type disc typewriter wherein the applied forces are electronically generated.

In typewriters employing type discs known to the art, the positioning of the type disc is accomplished by stepper motor or servo motor drives. In systems using stepper or servo motor drives, it is usual to cause positioning in the fastest time possible, i.e., in such a way that positioning through small angles is accomplished in shorter intervals than positioning through larger angles. This is done so that an average typing speed as high as possible may be attained with an operating cycle variable in time. To accomplish such control, expensive electronics including position feedback circuitry are necessary to produce motion varying with time as a function of the magnitude of angular positioning movement. The expense of such circuitry is unacceptably high in typewriters which are intended for use at limited typing speeds.

In accordance with the invention, a typewriter having relatively inexpensive electronics to control positioning of a type disc is provided. A balanced force positioning system is used wherein the sequence of movements required for the positioning of a type disc is brought about solely by generating a magnetic force of a magnitude corresponding to a selected position of the type disc acting to establish a new equilibrium of forces at each selected position and of a magnitude to effect equilibrium within a given time. The magnetic force generated acts to move an armature of a motor or one associated with a moving coil magnet; the armature comprising with the type disc and supporting shaft a mass associated with a spring. Movement of the armature rotates the type disc against the spring until the forces are in equilibrium at a selected position. Each new position of the type disc is maintained until the magnetic force corresponding to a new position is generated. The motion from one equilibrium position to another is accomplished in a given time by properly selecting the parameters of the spring mass system. A feature of the invention resides in a system for converting digital position codes into analogue voltage values and using pulse modulation techniques to enable amplification of the full range of voltage magnitudes corresponding to all positions on the type disc.

An object of the invention is to provide an inexpensive positioning mechanism and electronic controls therefor.

Another object of the invention is in the provision of a type disc positioning system in the form of a balanced force system wherein at each selected position of the type disc equilibrium conditions are established in a given time.

Other objects and many of the attendant advantages of this invention will be readily appreciated as the same becomes better understood by reference to the following detailed description when considered in connection with the accompanying drawing in which like reference numeral designate like parts throughout the figures thereof and wherein:

FIG. 1 is a perspective view showing the mechanical elements of the positioning device with a solenoid drive;

FIG. 3 is a static diagram depicting the operation of a positioning device with a spring-mass system according to the invention;

Figure 6:
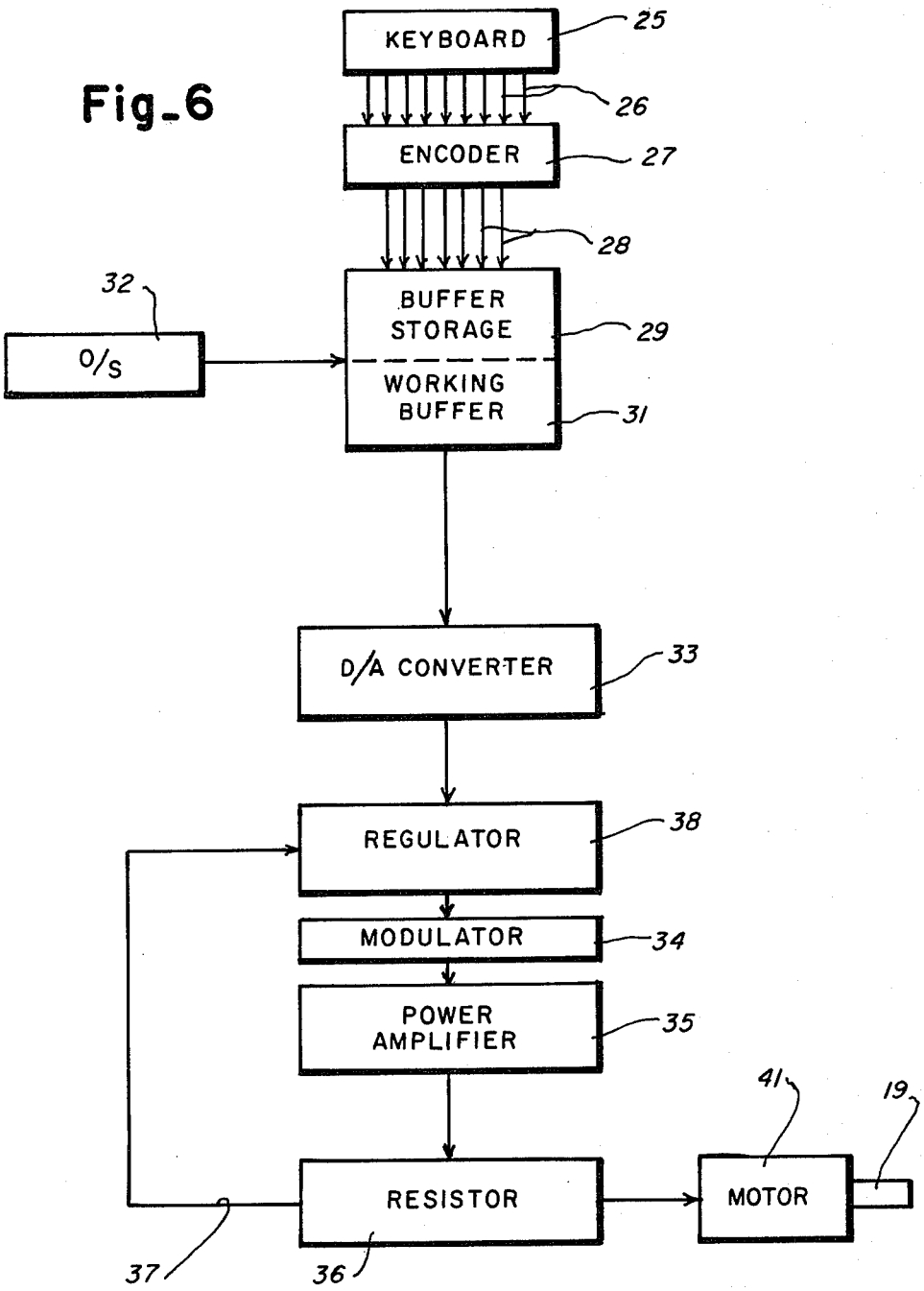

FIGS. 4*a* and 4*b* are curves showing the natural oscillation processes occurring in the positioning process with the spring-mass system according to the invention with different degrees of damping;

FIGS. 5*a* and 5*b* are curves illustrating pulse width and frequency modulated voltages whereby position-correlated mean voltages required for positioning the type carrier are generated;

FIG. 6 is a block diagram of a constant current electronic control for the positioning system of the invention; and FIG. 7 is a perspective view showing an alternative mechanical embodiment of the positioning device with an electric motor drive.

Referring now to the drawing, there is shown in FIG. 1 a single element print carrier in the form of a type disc 10 secured to and mounted for rotation with a shaft 11 and located in front of a platen 12.

Type faces facing the platen 12 are located on the ends of spokes 13 of the type disc 10 and the type face on the spoke 13 located at the twelve o'clock position is at the printing position 14 whereat a hammer (not shown) may impact it against the platen 12 through a ribbon (not shown). The spokes 13 are associated with "position codes" in ascending sequence. Assuming that there are 96 spokes 13 circularly arranged on type disc 1, the ascending sequence of the position codes starts with "one" and ends with "96".

The shaft 11 is rotatably mounted on a support generally designated 15, and, as understood in the art the support 15 may be fixed in a machine frame having a transversely movable platen 12, or mounted for movement across the writing line in a machine having a fixed platen 12. The end of the shaft 11 opposite the end mounting the type disc 10 carries, in the embodiment of FIG. 1, a pulley 16. An extension 17 spring anchored at one end to the support 15 has its other end connected to one end of a strand 18 which is wound about the pulley 16 and which has its other end connected to the bar armature 19 of a moving coil magnet. The armature 19 is mounted for axial movement relative to a permanent magnet structure 20, also secured to the support 15 on the other side of the shaft 11. The armature 19 has a winding 21 wrapped therearound and when a current is passed through the winding as by application of voltage to leads 22 the interacting magnetic fields result in movement of the armature 19. In this system the translatory movement of the armature 19 is transformed into rotary movement of the shaft 11 and energy is stored or released in the spring 17 as the deflection of the spring 17 is increased or decreased.

In a preferred embodiment, in order to assure positive transmission of forces between pulley 16 and strand 18, i.e. to remove play, a voltage $V_m$ representing position "one" is normally applied to the leads 22 of the moving coil magnet winding 21. The resulting current and magnetic force $F_m$ pull the armature 19 to the left as viewed in FIG. 1 to establish a basic rest or "one" position of the type disc 10. In this basic position the spring 17 is deflected correspondingly and the two opposing forces, the magnetic force $F_m$ and the spring force $F_s$ resulting from the deflection of the spring 17, are in balance or in equilibrium. At this basic rest position, the "one" spoke 13 is positioned at printing position 14.

The conditions at the basic rest position "one" and the rest position "three" are statically illustrated in FIG. 3 wherein the ordinate below the abscissa represents binary position codes, the ordinate above the abscissa represents the magnetic and spring forces $F_m$ and $F_s$, the abscissa to the left of the ordinate represents applied voltages, the abscissa to the right of the ordinate represents angular type disc positions and lines 23 and 24 represent moving coil magnet winding and spring constants $K_w$ and $K_s$. As shown in FIG. 3 the "one" position code is converted, in a digital-analogue converter as will hereinafter appear, to a voltage of corresponding magnitude for application to the winding 21 of the moving coil magnet. The resulting current therein will develop a magnetic force $F_m$ acting on armature 19 which will cause the disc 10 to rotate to disc position "one". This will result in the deflection of the spring 17 which will exert an opposite spring force $F_s$. The static basic position "one" is reached when the forces $F_m$ and $F_s$ are in equilibrium. Higher position codes convert to higher voltages thereby to establish new equilibrium conditions whereat higher numbered spokes 13 are positioned at the print position 14.

Figure 2:
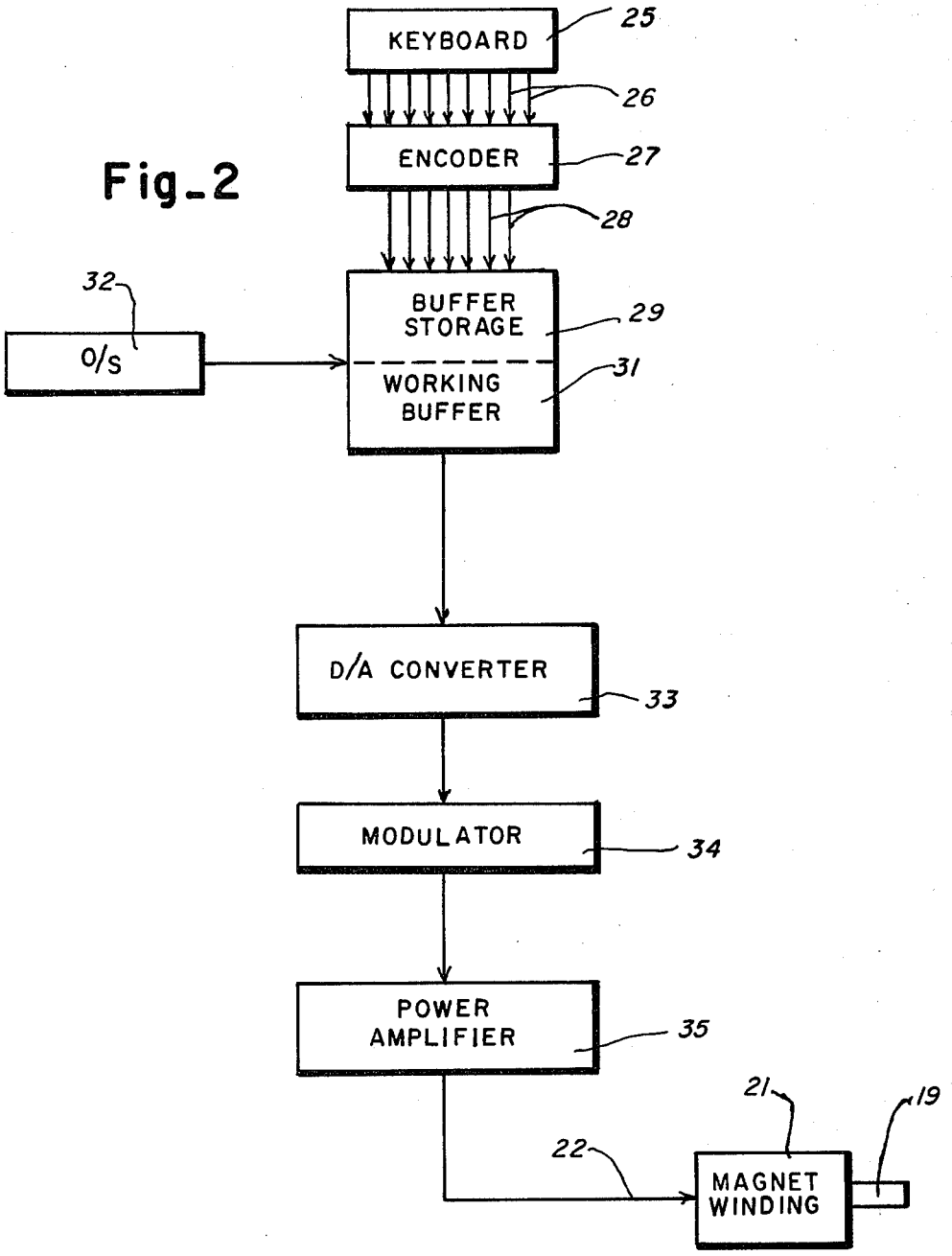
FIG. 2 is a block diagram of an electronic control for a device according to FIG. 1.

With reference to FIG. 2, the printer shown in FIG. 1 may be operated from a keyboard 25 which generates in response to each character key depression a discrete signal. These signals are conveyed over lines 26 to an encoder 27 to produce binary digital position codes representing the number position of a character on the disc 10 corresponding to the key selected on the keyboard 25. A seven bit code is adequate to provide a code for each of the 96 spokes 13. The position codes are immediately transferred over bit lines 28 to an intermediate or buffer storage unit 29 capable of storing a predetermined number of position codes. The position codes in buffer storage 29 are transferred one at a time to a single character working buffer 31. Upon each entry into the working buffer 31 a cycle timer, e.g. a monostable or one-shot multivibrator 32, is set and while it is active the transfer of another position code from buffer storage 29 to working buffer 31 is blocked. When the cycle timer 32 times out, another position code is transferred from buffer storage 29 to working buffer 31 with the new position code erasing the previous code therein. During the active period of the cycle timer 32, the type disc 10 is positioned to the number position represented by the position code in the working buffer 31 and the positioned character printed. More particularly, the position code in working buffer 31 is applied to a digital to analogue converter 33 which develops a d.c. voltage of a magnitude representing the position code. The d.c. output voltage is conveyed to a modulator 34 which drives power amplifier 35 whose output is applied to drive current through the moving coil magnet winding 21 of a magnitude sufficient to develop the magnetic force $F_m$ necessary to position the type disc 10 at the number position represented by the position code.

In that the magnitude of the voltage $V_m$ necessary to drive the type disc 10 increases according to the position from the basic "one" position, i.e. increases with the angle through which the disc 10 must be driven, and due to limitations of the dynamic characteristic of an amplifier to handle the full range of voltage magnitudes corresponding to positions 1-96 without distortion, the power amplifier 35 employed is a pulsed amplifier with an operating point on its dynamic load characteristic set to handle the largest input voltage, i.e. the one corresponding to number position "96", without distortion.

Accordingly, the differing voltage magnitudes corresponding to the full range of position codes "1" to "96" produced by the digital to analogue converter 33 are applied over the cycle time first to the pulse generating circuit or modulator 34, which generates a train of pulses. In one embodiment pulses are generated at a constant pulse frequency and the widths of the pulses vary in response to the voltage applied and are of a magnitude corresponding to the highest voltage necessary to drive the disc 360°, i.e. to position "96". Such pulse generating circuits are known to the art and may comprise a free running multivibrator having a varistor in one RC circuit thereof. These pulse trains are applied to the power amplifier 35 whose output as applied to the moving coil magnet winding 21 represents a mean voltage $V_m$, determined by the ratio of pulse on time to off time, which is the magnitude of the voltage corresponding to the position code in the working buffer 31.

FIG. 5*a*, shows a number of pulse trains designated a-e having pulse widths produced by the highest voltage applied to the pulse generator; 75% of the highest applied voltage, 50% of the highest applied voltage, 25% of the highest applied voltage, and zero applied voltage. The dotted lines through the pulse trains indicate the mean voltage values $V_m$ at the output of the power amplifier 35.

Alternatively, the differing voltages magnitudes at the output of the digital to analogue converter 33 corresponding to the full range of position codes may be converted to trains of constant width pulses of variable frequency, as shown in FIG. 5*b* wherein frequency variations are controlled according to the voltage magnitude corresponding to a position code. The frequency modulated pulse trains after amplification in the power amplifier result in mean voltage values, indicated by dotted lines, determined by the ratio of pulse on time to off time, corresponding to the position code in working storage. Such variable frequency pulse generating circuits are known to the art.

As hereinbefore noted, a change in current in the moving coil magnet winding 21 to drive the disc 10 from a lower number position to higher number position will cause the armature 19 to accelerate in a direction which deflects the spring 17 which will develop a counter spring force $F_s$. Movement of the armature 19 will also cause a counter or back EMF proportional to armature velocity to be induced in the winding 21. This counter EMF counteracts the voltage applied, thereby reducing the current and the magnetic force $F_m$ pulling the armature with a resulting damping effect.

Thus, as the type disc 10 approaches the number position corresponding to the position code in the working buffer 31 the opposing spring force $F_s$ approaches and balances the force $F_m$ developed by the current in the winding 21 of the moving coil magnet. The decelleration of the positioning movement may be designed to occur at the natural frequency of the damped spring mass system so that the disc 10 will be positioned with opposing forces $F_m$ and $F_s$ reaching equilibrium to effect printing within the cycle time of the one-shot multivibrator 32. Variable design parameters include the spring constant $K_s$ of the spring, the masses involved, frictional forces, and coil and pole design. FIGS. 4*a* and 4*b* respectively, are curves showing angular rotation and velocity of the disc 10 versus time for systems with critical damping, $D=1$, i.e. rotation and velocity are zero at the desired position in a given time $t_1$, and in systems allowing some oscillation, $D<1$, about the desired angular position x.

When the desired angular position, i.e. a new character to be printed is between the existing angular equilibrium position and the basic "one" equilibrium position the spring force $F_s$ will be dominant and will accelerate the disc 10 in a return direction with decelleration controlled by armature movement under influence of magnetic force $F_m$ developed by the application of a new voltage to the winding 21 of the moving coil magnet.

For as long as there are character position codes in buffer storage 29 for transfer to the working buffer 31 the disc 10 will be positioned from spoke to spoke without returning to the basic "one" position. When, however, there is a pause in entry of position codes by an operator at the keyboard 24, no character position codes remain in buffer storage 29, and the machine is not turned off, the basic "one" position code is automatically entered into working buffer 31 in place of the last position code therein to reduce the level of current drawn by the winding 21 during pauses in typing thus to reduce power dissipation and heating.

It has been found that after prolonged operation the electric power dissipation in the winding 21 may lead to an increase of its ohmic resistance due to rising temperature of the winding 21. This means that the current flowing in the winding 21 of the moving coil magnet and hence also the magnetic $F_m$ force produced thereby will be reduced or diminished at constant terminal voltage, with the result that the positioning of the type disc 10 will not correspond to the applied voltage and the disc 10 will not be accurately positioned angularly. This may be overcome as shown in FIG. 6 by connecting a resistor 36 in series with the winding 21. From a tap on the resistor 36 the voltage drop proportional to the current is developed and supplied over line 37 to a current regulator 38. The resistor 36 is so selected so that at nominal current the resulting voltage drop corresponds exactly to the output voltage of the digital to analogue converter 33. In the current regulator 38, which may take the form of a differential amplifier, the two voltages are compared. If the feedback voltage is lower, the output voltage of the regualtor 38 is increased. If the feedback voltage is higher than the output voltage of the digital to analogue converter, the output voltage is reduced. The output voltage of the differential amplifier 38, therefore, is the corrected output voltage of the digital-analogue converter 33, and at the same time the input signal to the modulator 34.

Such constant current regulation will however also compensate for counter voltages induced in the winding 21 of the moving coil magnet upon movement of its armature 19 and will thereby abolish the damping effect thereof. As this is the case, an attenuator in the form of dash-pot 39 (FIG. 1) with a velocity proportional characteristic may be connected in parallel with the extension spring 17, in order that the positioning movement can take place as a damped build-up process.

FIG. 7 shows a preferred embodiment wherein instead of a moving coil magnet a d-c motor 41 is employed. The use of a motor 41 is advantageous in that it offers unlimited rotational movement of the armature thereof and an approximately constant torque over the angle of rotation at constant current; features not easily realized with the moving coil magnet arrangement.

Permanently excited d-c motors 41 with ironless bell-shaped rotors are especially well suited for this purpose as they have a linear characteristic.

Since a motor 41 provides a rotational movement a cable drive can be dispensed with and the motor shaft may be directly connected to or comprise the supporting shaft 11 of the type disc 10. Instead of an extension spring 17 a spiral spring 42 can be used with its inner end secured to the shaft 11 and its outer end to the support 15. With a control circuit as shown in FIG. 6 the motor may be provided with an eddy current brake 43 functioning like dash-pot 38 to provide damping.

The drive of such a d-c motor 41 occurs in the same manner as with a moving coil magnet and armature 19.

Alternatively, a d-c motor 41 may be employed in an arrangement according to FIG. 1 wherein the end of cable 18 formerly connected to the armature 19 associated with the moving coil magnet may be connected to the circumference of a pulley mounted on the motor shaft.

The invention claimed is:

1. In a typewriter comprising a shaft, means supporting said shaft for rotation;

a print disc mounted for rotation with said shaft, said disc having an array of radial spokes bearing characters to be printed, a keyboard for generating signals representing characters on said disc to be printed, means for digitally encoding said signals, means for converting said encoded signals into voltages whose magnitude represents the amount of rotation to be imparted to said disc to position a selected character thereon at a printing position opposite a printing hammer, and positioning means for rotatably moving said shaft to position a selected character on said disc at said printing position in response to said voltages, said positioning means comprising a balanced force system including spring means connected to apply forces urging said shaft in one rotational direction, and drive means energized by said voltages connected to apply forces uring said shaft in the opposite rotational direction thereby to establish an equilibrium of forces at a selected position in a given time.

2. A typewriter as recited in claim 1, said drive means comprising the armature of a moving coil magnet, said shaft having a pulley, and said armature and said spring means being connected to said pulley by a strand system.

3. A typewriter as recited in claim 1, said drive means comprising a d-c motor directly connected to drive said shaft.

4. A typewriter as recited in claim 1, said means for converting said encoded signals comprising a digital to analogue converter, modulator means for generating a train of constant amplitude constant frequency voltage pulses whose widths are a function of the magnitude of the voltage at the output of the digital to analogue converter, and a power amplifier responsive to said pulse trains for generating an output voltage for application to said drive means.

* * * * *